US009883778B2

(12) United States Patent
Vanderstegen-Drake et al.

(10) Patent No.: US 9,883,778 B2
(45) Date of Patent: Feb. 6, 2018

(54) MOBILE ROBOT

(71) Applicant: Dyson Technology Limited, Wiltshire (GB)

(72) Inventors: Mark Stamford Vanderstegen-Drake, Gloucester (GB); Adam William Rollo, Portsmouth (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 14/764,461

(22) PCT Filed: Jan. 28, 2014

(86) PCT No.: PCT/GB2014/050214
§ 371 (c)(1),
(2) Date: Jul. 29, 2015

(87) PCT Pub. No.: WO2014/118520
PCT Pub. Date: Aug. 7, 2014

(65) Prior Publication Data

US 2016/0000282 A1 Jan. 7, 2016

(30) Foreign Application Priority Data

Jan. 29, 2013 (GB) ..... 1301578.9

(51) Int. Cl.
*A47L 9/00* (2006.01)
*A47L 11/40* (2006.01)

(52) U.S. Cl.
CPC ..... *A47L 9/009* (2013.01); *A47L 11/4061* (2013.01); *A47L 11/4066* (2013.01);
(Continued)

(58) Field of Classification Search
CPC .. A47L 9/009; A47L 11/4061; A47L 11/4066; A47L 11/114072; A47L 2201/04; A47L 2201/00
(Continued)

(56) References Cited

U.S. PATENT DOCUMENTS 4,515,235 A 5/1985 Yamamoto et al.
5,720,077 A * 2/1998 Nakamura ..... A47L 11/4061 15/319
(Continued)

FOREIGN PATENT DOCUMENTS

CN 202477560 10/2012
EP 1 806 210 7/2007
(Continued)

OTHER PUBLICATIONS

Search Report dated May 24, 2013, directed to GB Application No. 1301578.9; 1 page.
(Continued)

*Primary Examiner* — Karen Beck
(74) *Attorney, Agent, or Firm* — Morrison & Foerster LLP

(57) ABSTRACT

A mobile robot including a body having a drive arrangement for driving the body on a surface, the body further including a bias for biasing a rear portion of the body in a direction away from the floor surface. The bias may include a spring-loaded swing arm located on a rear portion of the body and which is movable between stowed and deployed positions.

12 Claims, 14 Drawing Sheets

(52) U.S. Cl.
CPC ..... *A47L 11/4072* (2013.01); *A47L 2201/00* (2013.01); *A47L 2201/04* (2013.01)

(58) Field of Classification Search
USPC ..... 280/6.157
See application file for complete search history.

(56) References Cited

U.S. PATENT DOCUMENTS

| | | | | |
|---|---|---|---|---|
| 8,239,992 | B2 * | 8/2012 | Schnittman | A47L 11/34 15/319 |
| 2006/0053580 | A1 | 3/2006 | Woo | |
| 2007/0044258 | A1 * | 3/2007 | Damrath | A47L 11/28 15/98 |
| 2010/0316469 | A1 * | 12/2010 | Lert | B65G 1/045 414/273 |
| 2011/0245972 | A1 | 10/2011 | Yan | |
| 2013/0061420 | A1 * | 3/2013 | Vanderstegen-Drake | A47L 9/00 15/347 |
| 2014/0166375 | A1 * | 6/2014 | Windorfer | A47L 9/009 180/8.2 |
| 2015/0150429 | A1 * | 6/2015 | Yoo | A47L 11/4011 173/1 |
| 2016/0000282 | A1 * | 1/2016 | Vanderstegen-Drake | A47L 9/009 280/6.157 |
| 2016/0360942 | A1 * | 12/2016 | Pedlar | A47L 11/4061 |

FOREIGN PATENT DOCUMENTS

| | | |
|---|---|---|
| EP | 2 433 541 | 3/2012 |
| FR | 2 856 622 | 12/2004 |
| JP | 4-113201 | 10/1992 |
| JP | 6-297927 | 10/1994 |
| JP | 2002-284006 | 10/2002 |
| JP | 2003-79671 | 3/2003 |
| JP | 2004-16385 | 1/2004 |
| JP | 2006-155274 | 6/2006 |
| JP | 2009-15667 | 1/2009 |
| KR | 10-2006-0001471 | 1/2006 |
| WO | WO-97/40734 | 11/1997 |
| WO | WO-00/38025 | 6/2000 |
| WO | WO-2008/009886 | 1/2008 |

OTHER PUBLICATIONS

International Search Report and Written Opinion mailed Apr. 24, 2014, directed to International Application No. PCT/GB2014/050214; 10 pages.

* cited by examiner

MOBILE ROBOT

REFERENCE TO RELATED APPLICATIONS

This application is a national stage application under 35 USC 371 of International Application No. PCT/GB2014/050214, filed Jan. 28, 2014, which claims the priority of United Kingdom Application No. 1301578.9, filed Jan. 29, 2013, the entire contents of which are incorporated herein by reference.

FIELD OF THE INVENTION

The invention relates to a mobile robot. In particular, although not exclusively, the invention has utility in the context of domestic mobile robot applications such as robotic floor sweepers, vacuum cleaners, and floor washers that are used in a home or office environment, for example.

BACKGROUND OF THE INVENTION

It is becoming increasingly common to see mobile robotic appliances around the home or office environment. Typically these robotic appliances are in the form of robotic floor sweepers or vacuum cleaners. Examples of known robotic vacuum cleaners are the Roomba™ range of machines manufactured by iRobot Corporation, the Navibot™ range of machines manufactured by Samsung, and the Electrolux Trilobite™, which is described in part in WO97/40734. It is notable that the vacuum cleaner in WO97/40734 includes its heavier components such as the electronics and vacuum motor in a rearwards portion of the housing whilst the dirt collecting chamber is located in a forward portion of the housing, with reference to its normal direction of travel.

A robotic vacuum cleaner is required to travel around an environment treating the floor as it goes. A home or office may not have entire floor space on one level so there may be various undulations and transitions that a robot must be able to negotiate in order to perform its task effectively. For example, there may be a small vertical step between rooms and/or between types of floor coverings within the floor space. Also, the robot may be required to climb onto a temporary floor covering such as a rug.

The 'climbing ability' of a domestic mobile robot depends on a large extent on its overall configuration. It will be appreciated for example that if a robots centre of mass is biased significantly towards a rearward portion of the robot there is a risk of the robot becoming 'beached' whilst negotiating a transition. This may affect vacuum cleaning robots which are configured such that their heavier components such as vacuum motor, battery and electronics are housed in a rear portion of the machine, whilst its relatively light components such as a dirt collecting bin are cited towards a forward portion of the machine. Such a configuration is apparent in WO97/40734.

SUMMARY OF THE INVENTION

It is against this background that the invention provides a mobile robot comprising a body having a drive arrangement for supporting and driving the body on a surface, and biasing means for biasing a rear portion of the body in a direction away from the floor surface.

The invention provides a particular advantage in mobile robots whose centre of mass is located in a relatively rearward position. A mobile robot with such a 'rearward-biased' centre of mass may have a relatively strong ability to climb over transitions since it is less massive at its front thereby requiring less driving energy to lift its forward section up and over a transition. However, the rearward bias of its mass can cause the robot to become stuck or 'beached' if its main drive arrangement is unable to pull the rear section of the robot up and over the transition. The present invention provides mechanically elegant solution to this problem by providing a means to upwardly bias a rear portion of the mobile robot away from the floor surface whilst retaining the benefits of a mobile robot with a rearwards biased centre of mass.

In one embodiment the biasing means may take the form of a floor engaging support member arranged support a rear portion of the body. This arrangement therefore serves to push the rear portion away from the floor surface with a predetermined force which has the affect of 'tipping' the body forward in circumstances when the robot becomes stuck on a transition, which may be a shallow step, for example.

So as to ensure a low physical profile of the floor engaging member, it may be stowable in a suitable bay or recess in the body and movable between stowed and deployed positions. A particularly convenient configuration to achieve the above functionality is provided by a swing arm that pivots relative to the body of the robot and arranged to stow in the recess, either partly or fully, when the robot is at rest on a surface.

The floor engaging support member may rotate relative to the body about a substantially vertical axis. The floor engaging support member may comprise a carrier rotatably mounted to the body and a swing arm pivotally mounted to the carrier, the carrier being able to rotate relative to the body about a substantially vertical axis and the swing arm being able to pivot relative to the carrier about a substantially horizontal axis.

To achieve the predetermined downward force a spring member may be arranged to act on the floor engaging support member. Although the spring member may be a helical compression spring, for example, it may also be a torsion spring braced between the swing arm and the body so as to bias the swing arm into the deployed position.

Although the swing arm may be fitted with a runner or skid to reduce frictional contact between it and the adjacent floor surface, a preferable option is to provide the swing arm with a roller or wheel.

In order to provide its biasing force in a balanced position, the swing arm may be located on a rear portion of the body aligned on a longitudinal axis of the body. A further option will be to position the swing arm between a pair of further floor engaging supports, for example fixed and passive wheels or rollers which reduces the load on the spring-loaded swing arm.

BRIEF DESCRIPTION OF THE DRAWINGS

In order that the invention may be more readily understood, embodiments will now be described by way of example only with reference to the accompanying drawings, in which.

DETAILED DESCRIPTION OF THE INVENTION

Figure 1:
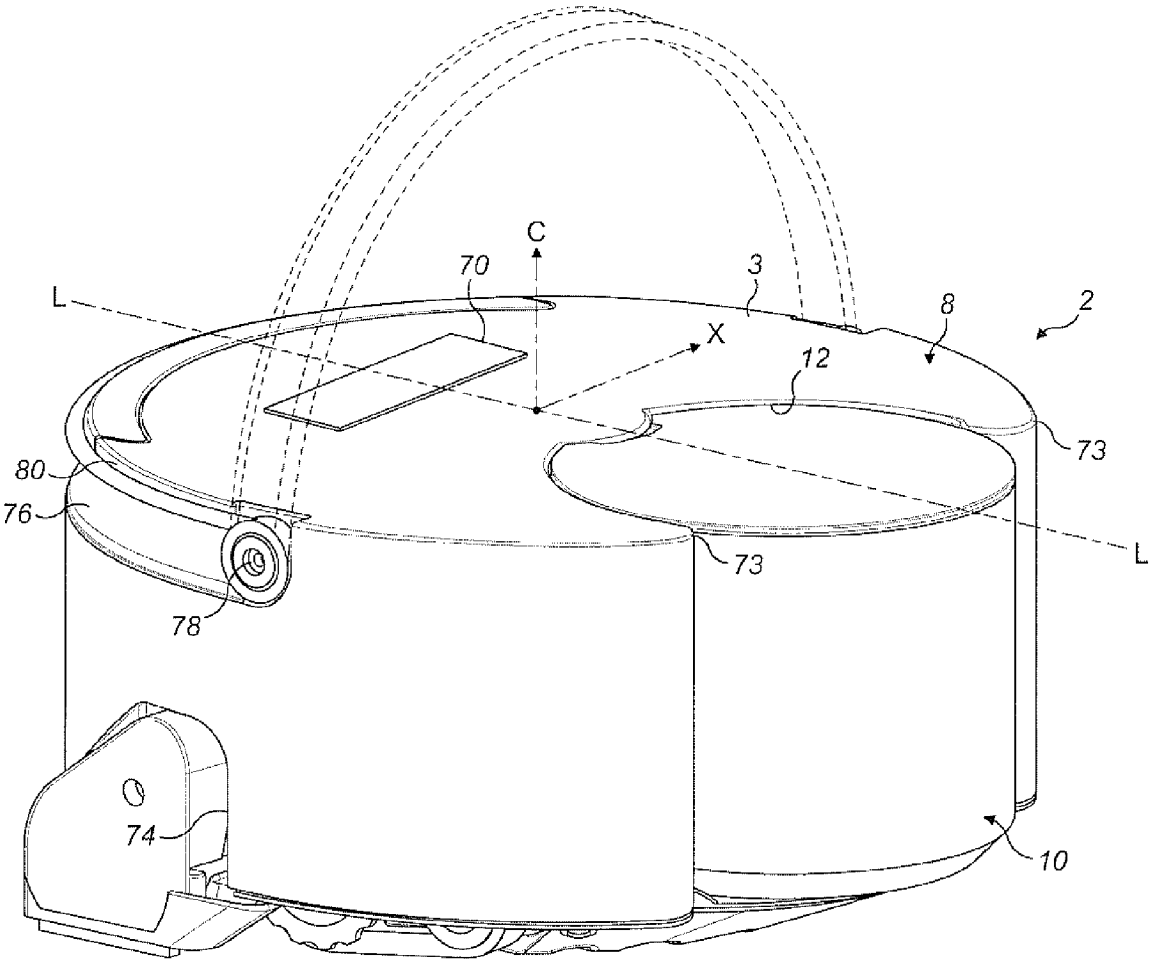
FIG. 1 is a front perspective view of a mobile robot in accordance with an embodiment of the invention.

With reference to FIGS. 1, 2, 3 and 4 of the drawings, an autonomous surface treating appliance, in the form of a mobile robotic vacuum cleaner 2 (hereinafter 'robot') comprises a main body 3 having four principal assemblies: a chassis (or sole plate) 4, a body 6 which is carried on the chassis 4, a generally circular outer cover 8 which is mountable on the chassis 4 and provides the robot 2 with a generally circular profile, and a separating apparatus 10 that is carried on a forward part of the body 6 and which protrudes through a complementary shaped cut-out 12 of the outer cover 8.

For the purposes of this specification, the terms 'front' and 'rear' in the context of the robot will be used in the sense of its forward and reverse directions during operation, with the separating apparatus 10 being positioned at the front of the robot. Similarly, the terms 'left' and 'right' will be used with reference to the direction of forward movement of the robot. As will be appreciated from FIG. 1, the main body of the robot 2 has the general form of a relatively short circular cylinder, largely for maneuverability reasons, and so has a cylindrical axis 'C' that extends substantially vertically relative to the surface on which the robot travels. Accordingly, the cylindrical axis C extends substantially normal to a longitudinal axis of the robot 'L' that is oriented in the fore-aft direction of the robot 2 and so passes through the centre of the separating apparatus 10.

The chassis 4 supports several components of the robot and is preferably manufactured from a high-strength injection moulded plastics material, such as ABS (acrylonitrile butadiene styene), although it could also be made from appropriate metals such as aluminium or steel, or composite materials such a carbon fibre composite to name a few examples. As will be explained, the primary function of the chassis 4 is as a drive platform and to carry cleaning apparatus for cleaning the surface over which the robot travels.

Figure 3:
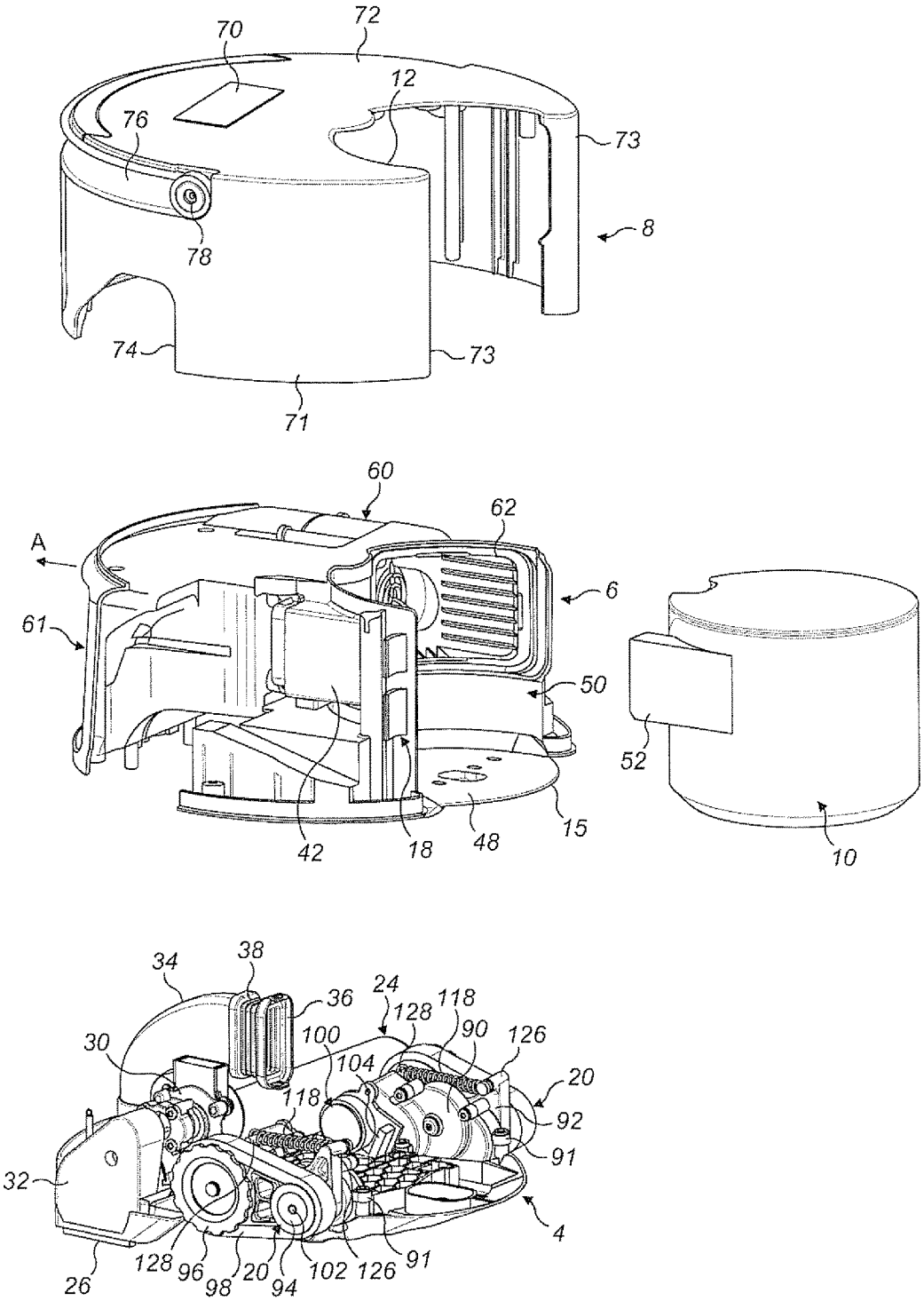
FIG. 3 is an exploded perspective view of the mobile robot of FIG. 1 showing its main assemblies.

With particular reference to FIG. 3, a front portion 14 of the chassis 4 is relatively flat and tray-like in form and defines a curved prow 15 that forms the front of the robot 2. Each flank of the front portion 14 has a respective traction unit 20 mounted to it.

The pair of traction units 20 are located on opposite sides of the chassis 4 and are operable independently to enable to robot to be driven in forward and reverse directions, to follow a curved path towards the left or right, or to turn on the spot in either direction, depending on the speed and direction of rotation of the traction units 20. Such an arrangement is sometimes known as a differential drive, and detail of the traction units 20 will be described more fully later in the specification.

The relatively narrow front portion 14 of the chassis 4 widens into rear portion 22 which includes a surface treating assembly 24 or 'cleaner head' having a generally cylindrical form and which extends transversely across substantially the entire width of the chassis 4 relative to its longitudinal axis 'L'.

Figure 2:
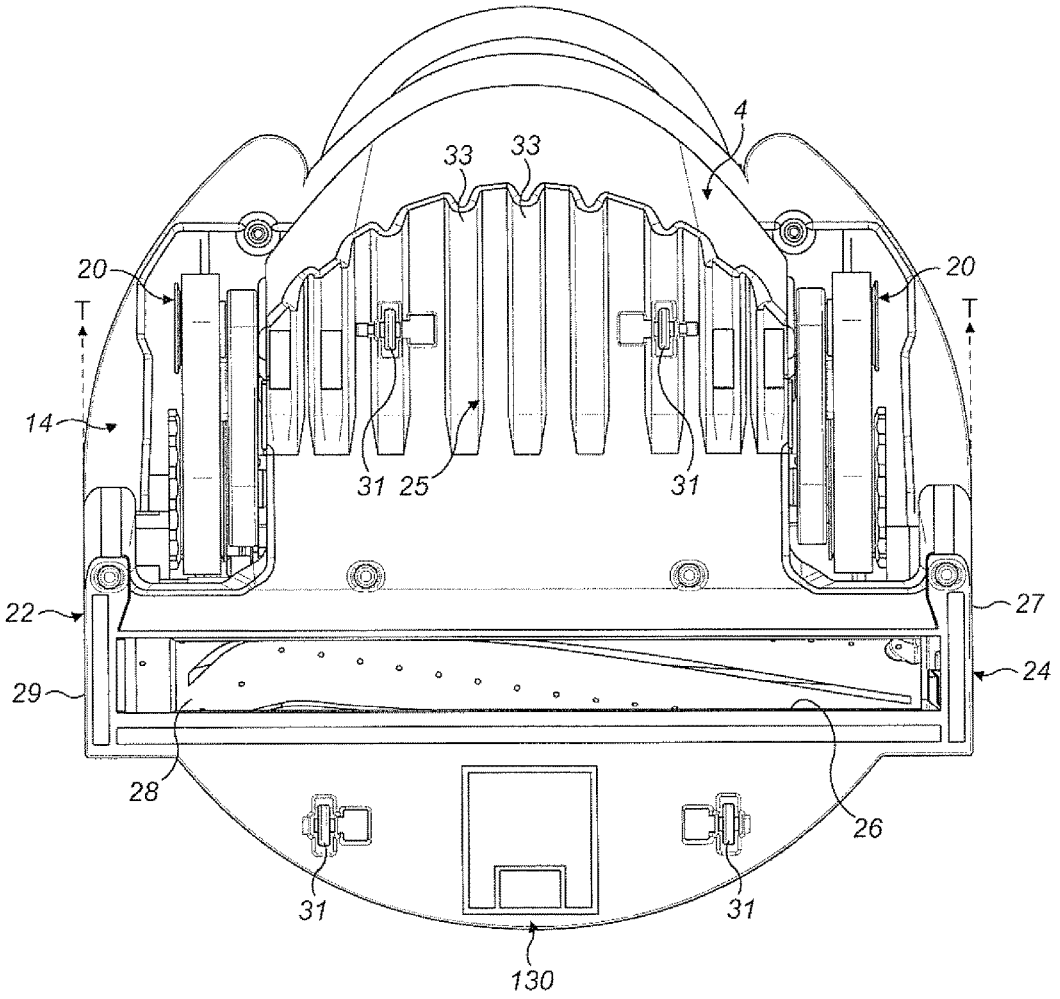
FIG. 2 is a view from beneath of the mobile robot in FIG. 1.

With reference also to FIG. 2, which shows the underside of the robot 2, the cleaner head 24 defines a rectangular suction opening 26 that faces the supporting surface and into which dirt and debris is drawn into when the robot 2 is operating. An elongate brush bar 28 is contained within the cleaner head 24 and is driven by an electric motor 30 via a reduction gear and drive belt arrangement 32 in a conventional manner, although other drive configurations such as a solely geared transmission or a direct drive are also envisaged. Moreover, although a wheel-based drive arrangement is shown, other drive systems are also acceptable such as a legged-based system.

The underside of the chassis 4 features an elongate sole plate section 25 extending forward of the suction opening 26 which includes a plurality of channels 33 (only two of which are labeled for brevity) which provide pathways for dirty air being drawn towards the suction opening 26. The underside of the chassis 4 also carries a plurality (four in the illustrated embodiment) of passive wheel or rollers 31 which provide further bearing points for the chassis 4 when it is at rest on or moving over a floor surface. The rollers 31 therefore serve to space the underside of the chassis a predetermined minimum distance (approximately 5 mm in this embodiment, although this is not essential) from the floor surface which benefits the performance of the brush bar.

In this embodiment, the cleaner head 24 and the chassis 4 are a single plastics moulding, thus the cleaner head 24 is integral with the chassis 4. However, this need not be the case and the two components could be separate, the cleaner head 24 being suitably affixed to the chassis 4 as by screws or an appropriate bonding technique as would be clear to the skilled person.

The cleaner head 24 has first and second end faces 27, 29 that extend to the edge of the chassis 4 and which are in line with the cover 8 of the robot. Considered in horizontal or plan profile as in FIGS. 2 and 3, it can be seen that the end faces 27, 29 of the cleaner head 24 are flat and extend at a tangent (labeled as 'T') to the cover 8 at diametrically opposed points along the lateral axis 'X' of the robot 2. The benefit of this is that the cleaner head 24 is able to run extremely close to the walls of a room as the robot traverses in a 'wall following' mode therefore being able to clean right up to the wall. Moreover, since the end faces 27, 29 of the cleaner head 24 extend tangentially to both sides of the robot 2, it is able to clean right up to a wall whether the wall is on the right side or the left side of the robot 2. It should be noted, also, that the beneficial edge cleaning ability is enhanced by the traction units 20 being located inboard of the cover 8, and substantially at the lateral axis X, meaning that the robot can maneuver in such a way that the cover 8 and therefore also the end faces 27, 29 of the cleaner head 24 are almost in contact with the wall during a wall following operation.

Dirt drawn into the suction opening 26 during a cleaning operation exits the cleaner head 24 via a conduit 34 which extends upwardly from the cleaner head 24 and curves towards the front of the chassis 4 through approximately 90° of arc until it faces in the forwards direction. The conduit 34 terminates in a rectangular mouth 36 having a flexible bellows arrangement 38 shaped to engage with a complementary shaped duct 42 provided on the body 6.

The duct 42 is provided on a front portion 46 of the body 6, and opens into a forward facing generally semi-cylindrical recess 50 having a generally circular base platform 48. The recess 50 and the platform 48 provide a docking portion into which the separating apparatus 10 is mounted, in use, and from which it can be disengaged for emptying purposes.

It should be noted that in this embodiment the separating apparatus 10 consists of a cyclonic separator such as disclosed in WO2008/009886, the contents of which are incorporated by reference. The configuration of such separating apparatus is well known and will not be described any further here, save to say that the separating apparatus 10 may be removably attached to the body 6 by a suitable mechanism such as a quick-release fastening means to allow the apparatus 10 to be emptied when it becomes full. The nature of the separating apparatus 10 is not central to the invention and the cyclonic separating apparatus may instead separate dirt from the airflow by other means that are known in the art for example a filter-membrane, a porous box filter or some other form of separating apparatus. For embodiments of the apparatus which are not vacuum cleaners, the body 6 can house equipment which is appropriate to the task performed by the machine. For example, for a floor polishing machine the main body can house a tank for storing liquid polishing fluid.

When the separating apparatus 10 is engaged in the docking portion 50, a dirty air inlet 52 of the separating apparatus 10 is received by the duct 42 and the other end of the duct 42 is connectable to the mouth 36 of the brush bar conduit 34, such that the duct 42 transfers the dirty air from the cleaner head 24 to the separating apparatus 10. The bellows 38 provide the mouth 36 of the duct 34 with a degree of resilience so that it can mate sealingly with the dirty air inlet 52 of the separating apparatus 10 despite some angular misalignment. Although described here as bellows, the duct 34 could also be provided with an alternative resilient seal, such as a flexible rubber cuff seal, to engage the dirty air inlet 52.

Dirty air is drawn through the separating apparatus 10 by an airflow generator which, in this embodiment, is an electrically powered motor and fan unit (not shown), that is located in a motor housing 60 on the left hand side of the body 6. The motor housing 60 includes a curved inlet mouth 62 that opens at the cylindrical shaped wall of docking portion 50 thereby to match the cylindrical curvature of the separating apparatus 10. Although not seen in FIG. 4, the separating apparatus 10 includes a clean air outlet which registers with the inlet mouth 62 when the separating apparatus 10 is engaged in the docking portion 50. In use, the suction motor is operable to create low pressure in the region of the motor inlet mouth 62, thereby drawing dirty air along an airflow path from the suction opening 26 of the cleaner head 24, through the conduit 34 and duct 42 and through the separating apparatus 10 from dirty air inlet 52 to the clean air outlet. Clean air then passes through the motor housing 60 and is exhausted from the rear of the robot 2 through a filtered clean air outlet 61.

Figure 4:
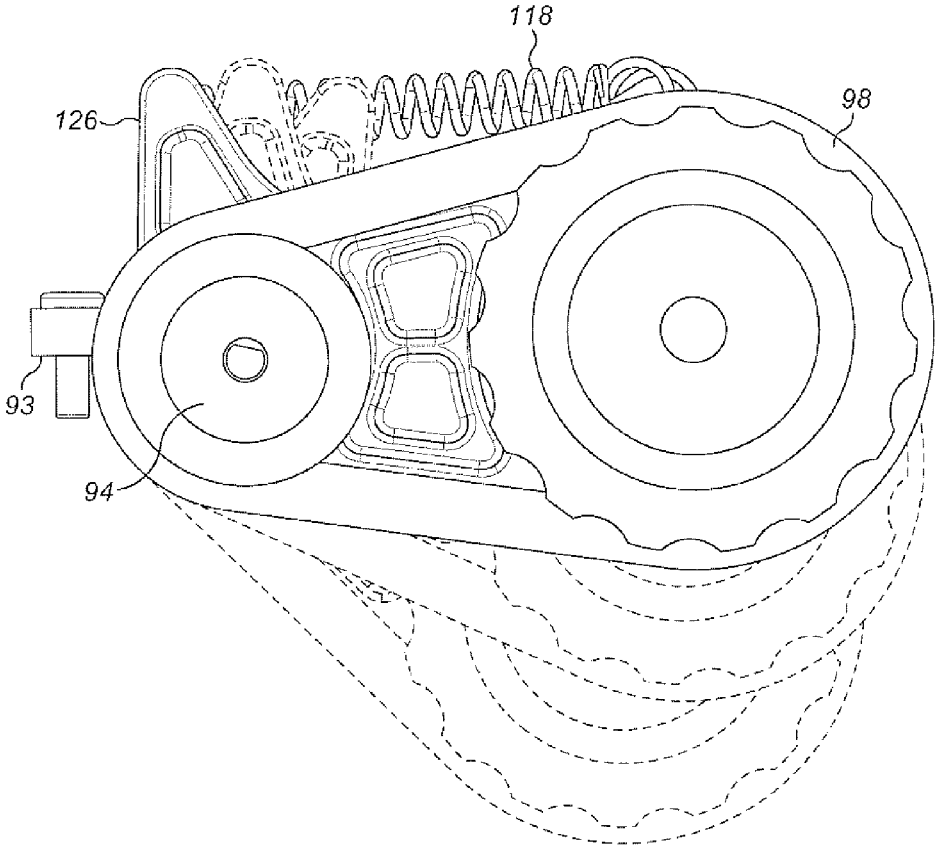
FIG. 4 is a side view of a traction unit of the mobile robot in FIGS. 1 to 3 and illustrates the range of movement of the traction unit.

The cover 8 is shown separated from the body 6 in FIG. 4 and, since the chassis 4 and body 6 carry the majority of the functional components of the robot 2, the cover 8 provides an outer skin that serves largely as a protective shell and to carry a user control interface 70.

The cover 8 comprises a generally cylindrical side wall 71 and a flat upper surface 72 which provides a substantially circular profile corresponding to the plan profile of the body 6, save for the part-circular cut-out 12 shaped to complement the shape of the docking portion 50, and the cylindrical separating apparatus 10. Furthermore, it can be seen that the flat upper surface 72 of the cover 8 is co-planar with an upper surface 10*a* of the separating apparatus 10, which therefore sits flush with the cover 8 when it is mounted on the main body.

As shown particularly clearly in FIGS. 1 and 3, the part-circular cut-out 12 of the cover 8 and the semi-cylindrical recess 50 in the body 6 provides the docking portion a horseshoe shaped bay defining two projecting lobes or arms 73 which flank either side of the separating apparatus 10 and leave between approximately 5% and 40%, and preferably 20%, of the apparatus 10 protruding from the front of the docking portion 50. Therefore, a portion of the separating apparatus 10 remains exposed even when the cover 8 is in place on the main body of the robot 2, which enables a user easy access to the separating apparatus 10 for emptying purposes.

Opposite portions of the side wall 71 include an arched recess 74 (only one shown in FIG. 3) that fits over a respective end 27, 29 of the cleaner head 24 when the cover 8 is connected to the body 6. As can be seen in FIG. 1, a clearance exists between the ends of the cleaner head 24 and the respective arches 74 order to allow for relative movement therebetween in the event of a collision with an object.

On the upper edge of the side wall 71, the cover 8 includes a semi-circular carrying handle 76 which is pivotable about two diametrically opposite bosses 78 between a first, stowed or retracted position, in which the handle 76 fits into a complementary shaped recess 80 on upper peripheral edge of the cover 8, and a deployed or extended position in which it extends upwardly, (shown ghosted in FIG. 1). In the stowed position, the handle 76 maintains the 'clean' circular profile of the cover 8 and is unobtrusive to the user during normal operation of the robot 2. Also, in this position the handle 76 serves to lock a rear filter door (not shown) of the robot 2 into a closed position which prevents accidental removal of the filter door when the robot 2 is operating.

In operation, the robot 2 is capable of propelling itself about its environment autonomously, powered by a rechargeable power source such as a battery pack (not shown). To achieve this, the robot 2 carries an appropriate control means which is interfaced to the battery pack, the traction units 20 and an appropriate sensor suite 82 comprising for example infrared and ultrasonic transmitters and receivers on the front left and right side of the body 6. The sensor suite 82 provides the control means with information representative of the distance of the robot from various features in an environment and the size and shape of the features. Additionally the control means is interfaced to the suction fan motor and the brush bar motor in order to drive and control these components appropriately. The control means is therefore operable to control the traction units 20 in order to navigate the robot 2 around the room which is to be cleaned. It should be noted that the particular method of operating and navigating the robotic vacuum cleaner is not material to the invention and that several such control methods are known in the art. For example, one particular operating method is described in more detail in WO00/38025 in which navigation system a light detection apparatus is used. This permits the cleaner to locate itself in a room by identifying when the light levels detected by the light detector apparatus is the same or substantially the same as the light levels previously detected by the light detector apparatus.

Turning to the traction units, in overview, the traction unit 20 comprises a transmission case 90, a linkage member 92 or 'swing arm', first and second pulley wheels 94, 96, and a track or continuous belt 98 that is constrained around the pulley wheels 94, 96.

The transmission case 90 houses a gear system which extends between an input motor drive module 100 mounted on an inboard side of one end of the transmission case 90, and an output drive shaft 102 that protrudes from the drive side of the transmission case 90, that is to say from the other side of the transmission case 90 to which the motor module 100 is mounted. The motor module 100 in this embodiment is a brushless DC motor since such a motor is reliable and efficient, although this does not preclude other types of motors from being used, for example brushed DC motors, stepper motors or hydraulic drives. As has been mentioned, the motor module 100 is interfaced with the control means to receive power and control signals and is provided with an integral electrical connector 104 for this purpose. The gear system in this embodiment is a gear wheel arrangement which gears down the speed of the motor module 100 whilst increasing available torque, since such a system is reliable, compact and lightweight. However, other gearing arrangements are envisaged within the context of the invention such as a belt or hydraulic transmission arrangement.

The traction unit 20 therefore brings together the drive, gearing and floor engaging functions into a self-contained and independently driven unit and is readily mounted to the chassis 4 by way of a plurality of fasteners 91 (four fasteners in this embodiment), that are received into suitable lugs on the chassis 4.

The traction unit 20 is mountable to the chassis so that the first pulley wheel 94 is in a leading position when the robot 2 is travelling forwards. The 'leading wheel' 94 may also be considered a sprocket since it is the driven wheel in the pair.

The swing arm 92 includes a leading end that is mounted to the transmission case 90 between it and the lead wheel 94 and is mounted so as to pivot about the drive shaft 102. The continuous belt or track 98 provides the interface between the robot 2 and the floor surface and, in this embodiment, is a tough rubberized material that provides the robot with high grip as the robot travels over the surface and negotiates changes in the surface texture and contours. Although not shown in the figures, the belt 98 may be provided with a tread pattern in order to increase traction over rough terrain.

Similarly, although not shown in the figures, inner surface of the belt 98 is serrated or toothed so as to engage with a complementary tooth formation (not shown) provided on the circumferential surface of the leading wheel 94 which reduces the likelihood of the belt 98 slipping on the wheel 94. In this embodiment, the trailing wheel 96 does not carry a complementary tooth formation, although this could be provided if desired.

As will be appreciated, the swing arm 92 fixes the leading and trailing wheels 94, 96 in a spaced relationship and permits the trailing wheel 96 to swing angularly about the leading wheel 94. The traction unit 20 also comprises swing arm suspension in the form of a coil spring 118 that is mounted in tension between a mounting bracket 126 extending upwardly from the leading portion of the swing arm 92 and a pin 128 projecting from the trailing portion of the transmission case 90. The spring 118 acts to bias the trailing wheel 96 into engagement with the floor surface, in use, and so improves traction when the robot 2 is negotiating an uneven surface such as a thick-pile carpet or climbing over obstacles such as electrical cables. FIG. 4 shows three exemplary positions of the traction unit 20 throughout the range of movement of the swing arm 92.

Referring once again to FIG. 2, in addition to the traction units 20 and the passive wheels 31, the chassis 4 is supported on a floor surface by biasing means in the form of a floor engaging support member, indicated generally at 130. In this embodiment the floor engaging support member 130 is a jockey wheel that is located on a rear portion 129 of the chassis 4 (and therefore also on the main body of the robot) and supports the rear portion 129 on a floor surface. More specifically, the jockey wheel 130 is located on the centerline L of the robot 2 equidistant from the two support wheels 31 also located on the rear portion of the chassis 4.

Reference will now be made to FIGS. 5 to 11 which show the jockey wheel 130 in more detail. It should be noted, here, that the robot 2 is shown in simplified form for clarity purposes.

Figure 5:
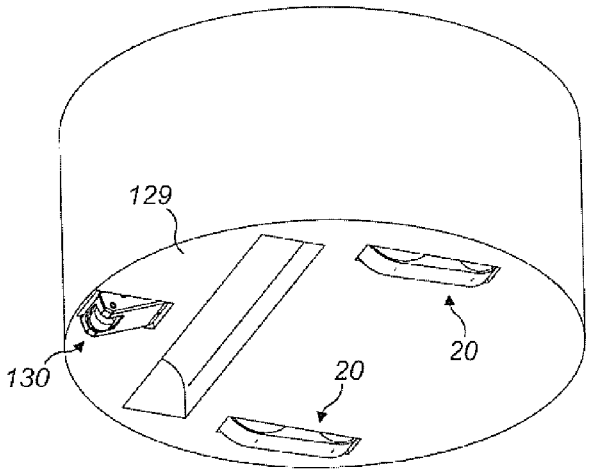
FIG. 5 is a simplified perspective view, from underneath, of the mobile robot of FIG. 1 showing a floor engaging support member in a deployed position.
Figure 6:
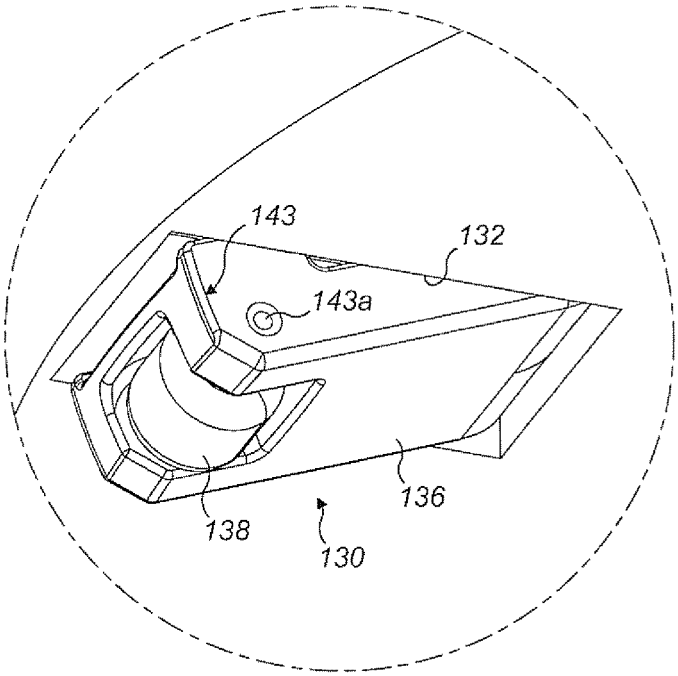
FIG. 6 is an enlarged view of the floor engaging support member in FIG. 5
Figure 7:
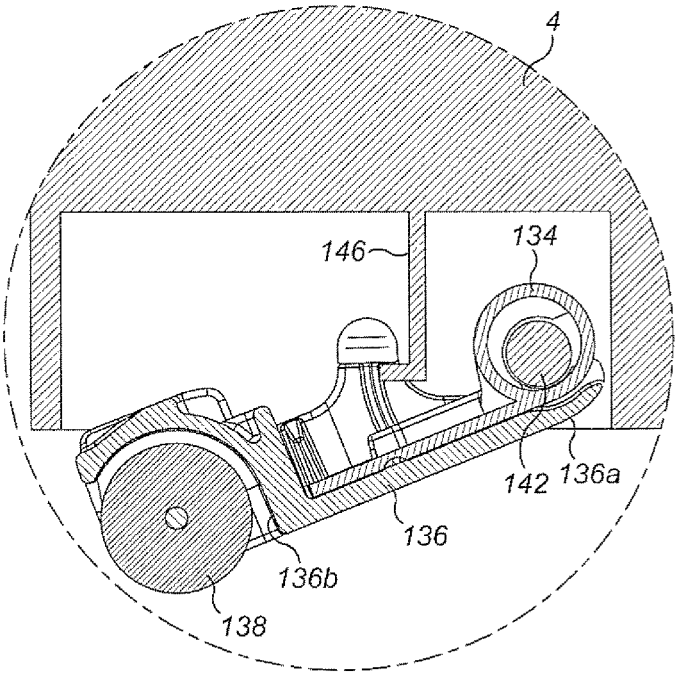
FIG. 7 is a longitudinal section through the floor engaging support member.
Figure 8:
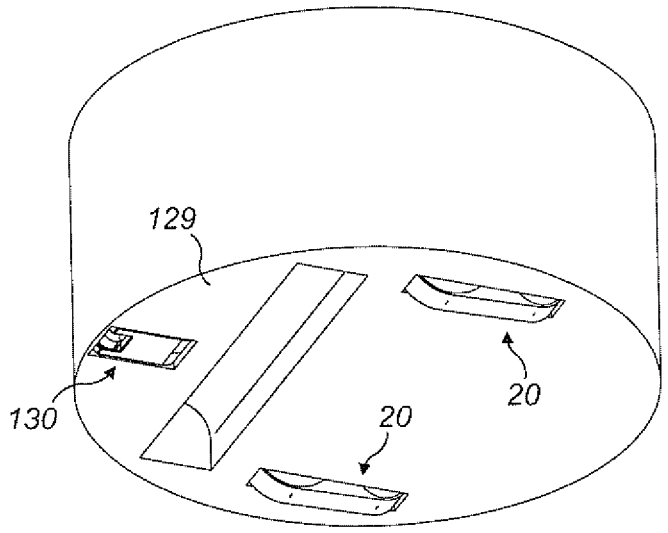
FIG. 8 is a simplified perspective view like that in FIG. 5 but which shows the floor engaging support member in a fully stowed position.
Figure 9:
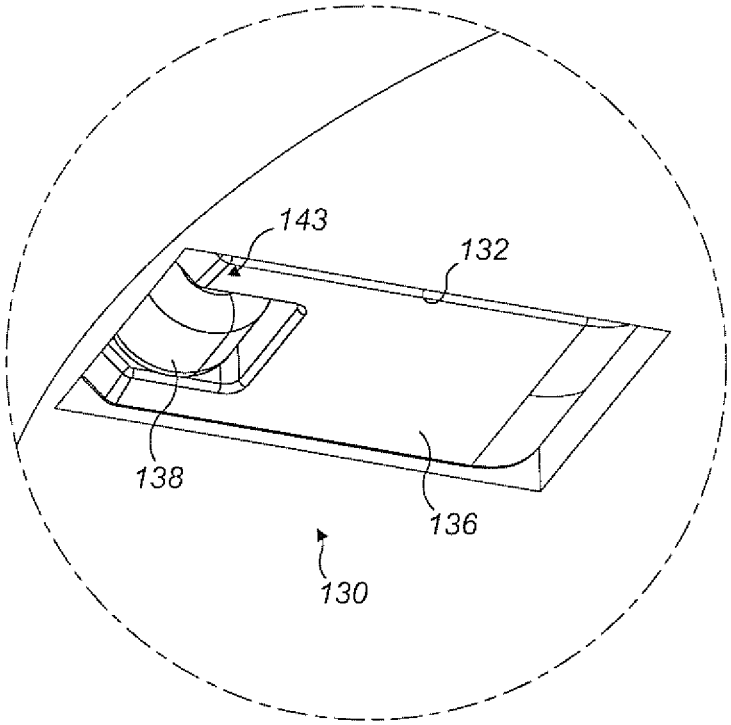
FIG. 9 is an enlarged view of the floor engaging support member in FIG. 8
Figure 10:
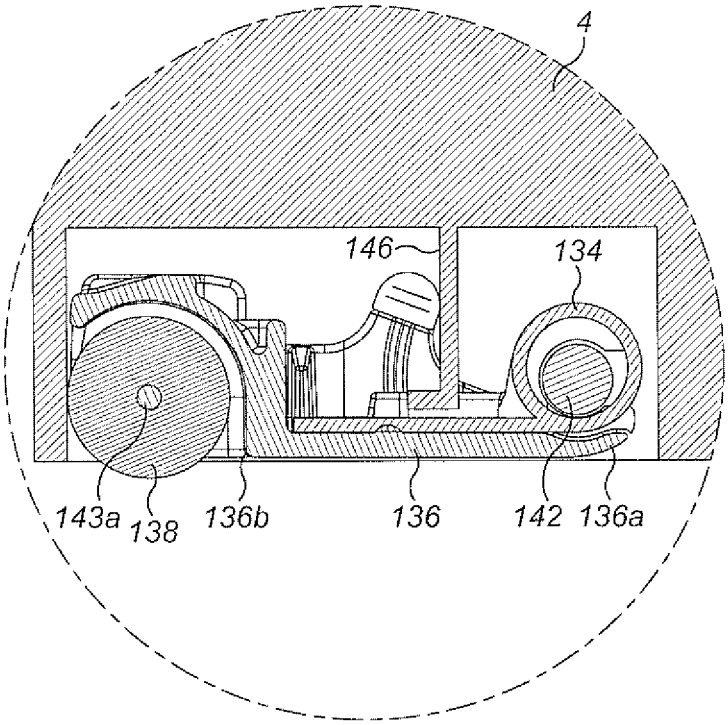
FIG. 10 is a longitudinal section through the floor engaging support member.
Figure 11:
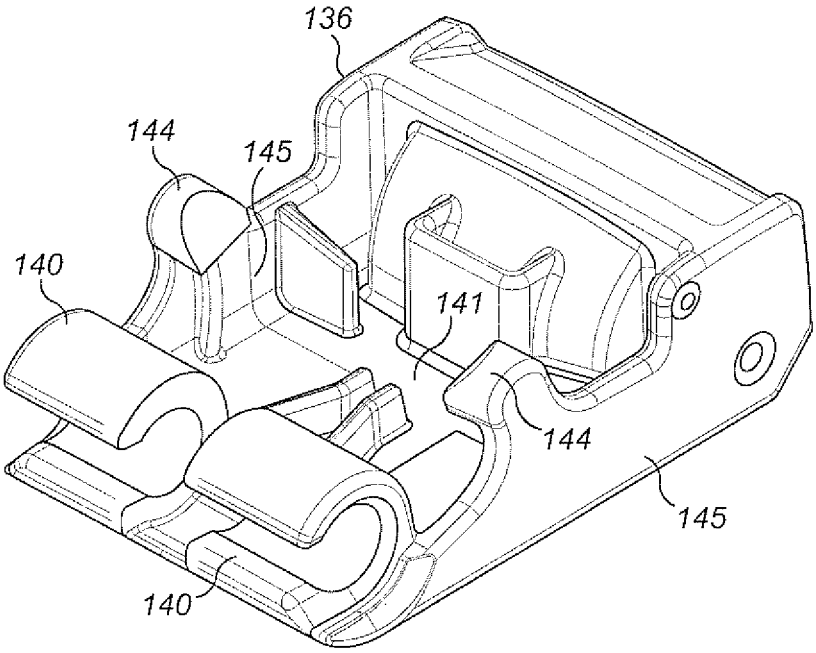
FIG. 11 is a perspective view of the floor engaging support member.

The jockey wheel 130 is mounted in a recess or 'bay' 132 defined in the underside of the chassis and is movable between a first position in which the jockey wheel 130 is stowed in the bay 132 (as shown in FIGS. 8, 9 and 10) and a second position in which the jockey wheel is deployed from the bay 132 (FIGS. 5, 6 and 7). The jockey wheel 130 is biased into the deployed position with a predetermined force by biasing means 134 which in this embodiment is a helical torsion spring although the skilled person would appreciate that the biasing means could have a different form such as a compression spring, a gas-filled spring and a resilient mass. Currently a helical torsion spring is preferred since it is compact and so lends itself to use in a tight volume.

In more detail, the jockey wheel 130 comprises an arm 136 that is pivoted at a first, inner, end **136*a* and includes a roller or wheel 138 that is mounted at a second, outer, end 136*b* of the arm 136. The arm 136 may be pivotably mounted in various ways, although in this embodiment the inner end 136*a* of the arm includes bearing means in the form of a pair of c-shaped mounts 140 that are secured by way of a snap fit to a pivot pin 142 provided on the chassis 4. Although not shown specifically in the Figures, it should be appreciated that the arrangement of the pivot pin 142 and the mounts 140** are such that the arm is pivoted about a horizontal axis that lies substantially parallel with the lateral axis X of the robot.

The torsion spring 134 is received over the pivot pin 142, as shown in FIG. 7, for example, and is braced between an inner part 141 of the arm 136 and a component of the chassis 4 and so outwardly biases the arm 136 into the deployed position. The jockey wheel 130 therefore serves as a biasing means to bias the rear portion 129 of the robot 2 in a direction away from the floor surface with a predetermined force. Note that the predetermined force is selected so that the jockey wheel 130 is able to lift the rear portion 129 of the robot 2 off of the floor surface and so this depends on the overall mass of the robot and also where that mass is distributed within the body of the robot; in this embodiment, however, the predetermined force is approximately 5 Newtons (5 N). Expressed another way, the predetermined force selected is a function of the machine mass and the position of the centre of mass along the longitudinal axis of the robot.

The outer end 136*b* of the arm 136 includes a yoke 143 within which the roller 138 is rotatably mounted on an axle 143*a*. Note that the roller 138 is mounted in the yoke 143 so that the roller 138 does not protrude significantly below the underside of the arm 136. The maximum outward travel of the arm 136 is limited by a pair of catches 144 defined by opposed walls 145 on either side of the arm 136. The catches 144 are engageable with a stop 146 that is provided on the chassis 4. In this embodiment, the roller 138 provides minimal rolling resistance to the mobile robot as it travels over a surface. However, the roller could also be replaced by an alternative such as a skid or runner if it was considered suitable for a particular mobile robotic application.

By virtue of the torsion spring 134 and the catches 144, the arm 136 applies a predetermined downward force throughout its range of angular movement until the arm 136 comes up against the stop 146. However, in normal operation the arm 136 and stop 146 are configured so that the arm 136 remains within its range of travel, which is approximately 30 degrees in this embodiment, although the precise range of movement is selected so as to provide the rear of the robot with enough upwards assistance during a climbing maneuver and so is largely depending on the dimensions of the robot. Preferentially, the arm 136 is movable so that the roller 138 may extend up to 20 mm below the underside of the chassis.

Figure 12A:
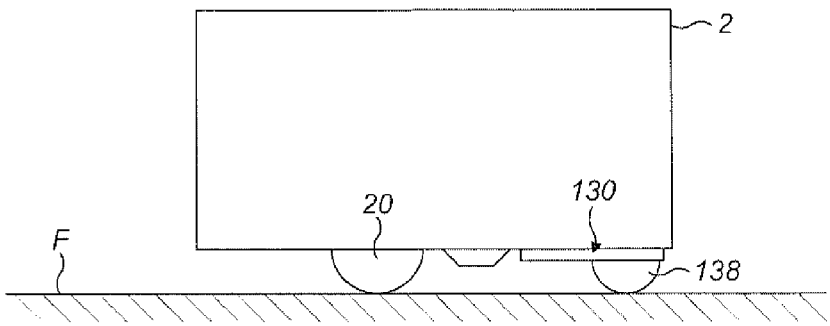
FIGS. 12*a* to 12*e* show sequential views of a simplified-form mobile robot of the preceding figures negotiating a transition in a floor surface.

FIG. 12*a* shows a schematic side view of the robot positioned on a floor surface F and it will be seen here that the jockey wheel 130 is in a relatively stowed position (although not fully stowed). In this position, the jockey wheel 130 exerts a downward force of approximately 5 N by virtue of the torsion spring 134.

The jockey wheel 130 is particularly advantageous in circumstances when the robot 2 is required to drive over a transition in the floor surface, and particularly a moderate step change in height. In such circumstances, since the centre of mass of the robot is rearwards-biased due to the location of the motor and fan unit and the relatively light separating apparatus 10 positioned at the front, there is a risk of the robot 2 losing traction on a step of a certain height so that it becomes stuck. However, the jockey wheel 130 urges the rear portion 129 of the robot 2 away from the floor surface which effectively tips the robot forward about the pivot point defined by the traction units 20 thereby assisting the robot in overcoming the obstacle.

The above scenario will now be described with reference to FIGS. 12*b* to 12*e* which are a sequence of side views illustrating the robot 2 approaching and climbing over a vertical transition T in the floor surface F.

Referring firstly to FIG. 12*a*, the mobile robot 2 is shown travelling across a floor surface F. In this condition, the jockey wheel 130 is in a stowed position and the robot is supported by the traction units 20 and the jockey wheel 138.

Figure 12B:
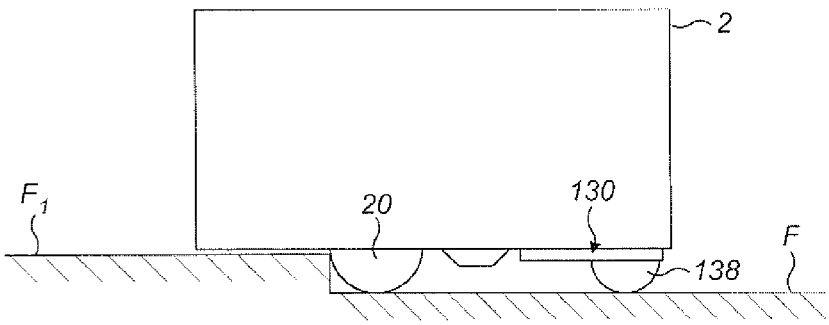

In FIG. 12*b*, the robot 2 is approaching a vertical transition T until the traction units 20 engage the transition and thus begin a climbing maneuver. As in FIG. 12*a*, the jockey wheel 130 remains retracted as the attitude of the robot remains flat.

Figure 12C:
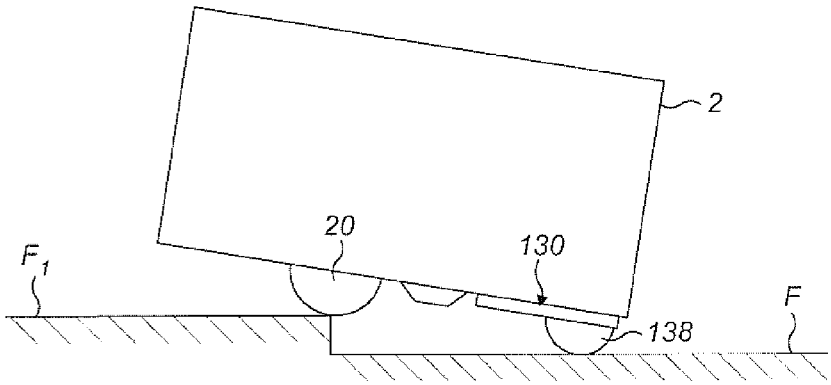
Figure 12D:
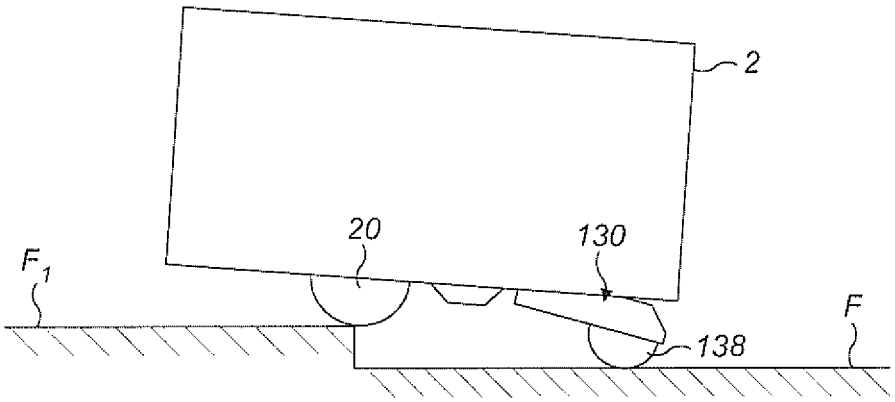

In FIG. 12*c*, the traction units 20 drive up the transition T so that the robot 2 is supported on the raised floor surface F1 by the traction units 20 and supported on the first floor surface F by the roller 138. At the point shown in FIG. 12*c*, the jockey wheel 130 comes into play as the upwardly directed biasing force it provides acts to 'tip' the robot 2 forwards as the robot 2 continues to move in its driving direction which assists the robot 2 in negotiating the transition T. Importantly, the jockey wheel 130 provides its biasing force throughout its range of movement and it is shown in a deployed position in FIG. 12*d* where it is seen that the robot 2 has tipped forward as compared the robot 2 in FIG. 12*c*. In effect, therefore, the jockey wheel 130 has an effect comparable to that of a mass located on a forward portion of the robot 2 which would forward-shift the centre of mass of the robot, or even to an upwards force applied to the upper surface of the mobile robot.

Figure 12E:
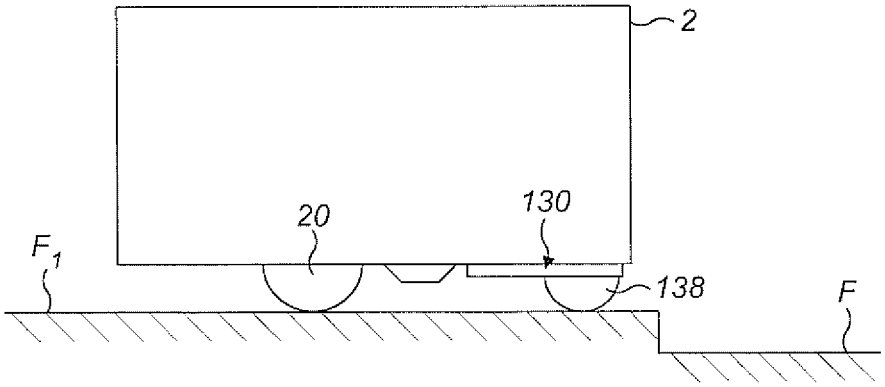

Turning to FIG. 12*e*, as the robot 2 continues in the forward direction on the raised transition surface F1, the jockey wheel 134 engages the transition T and is caused to move angularly in an anticlockwise direction so as to be stowed once again in the bay 132.

Some modifications to the specific embodiments have been explained in the discussion above. In addition to these, the skilled person would understand that the specific embodiment may be altered without departing from the scope of the invention as defined in the claims. Some non-limiting examples of such alternatives will now be discussed.

Figure 13A:
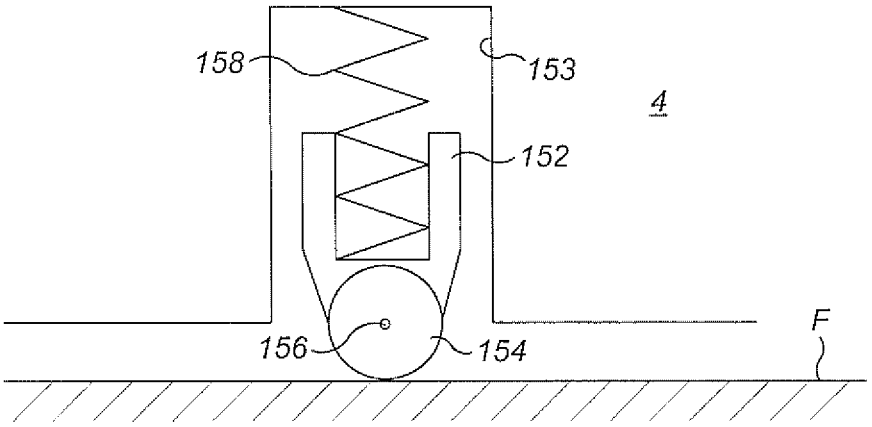
FIGS. 13*a* and 13*b* are schematic views of an alternative embodiment.
Figure 13B:
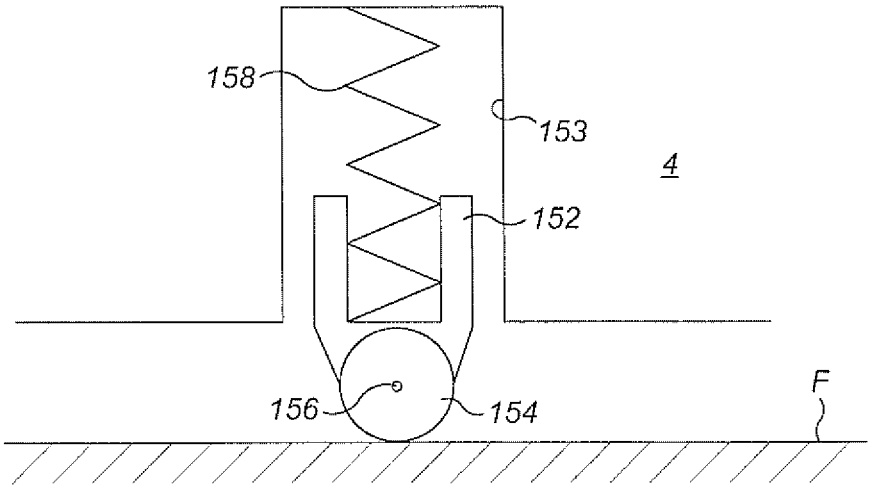

The jockey wheel has been described as broadly comprising a roller that is mounted to a swing arm. However, this is only one way of achieving the technical advantage. A similar result could be achieved by a floor engaging wheel mounted in the chassis for substantially linear vertical movement. By way of example, in FIG. 13*a* a jockey wheel arrangement 150 of an alternative embodiment, shown schematically, comprises a wheel support member 152 that defines a sliding fit in a recess 153 of the chassis 4 of the robot 2. The support member 152 supports a wheel 154 on an axle 156 at one end and its other end is engaged with a biasing spring 158 so that the support member 152 is biased outwards with respect to the chassis 4. As in the previous embodiment, the support member 152 adopts a stowed configuration when the robot 2 is travelling on a relatively flat region of the floor surface F, as is shown in FIG. 13*a*. However, in circumstances where the robot 2 is required to traverse a transition in the floor surface, such as shown in FIGS. 12*a* to 12*e*, the support member 152 may deploy or extend downwardly with respect to the chassis into the position shown in FIG. 13*b*.

In the previously described embodiments the floor engaging support member is a jockey wheel 138 which has a fixed orientation. The wheel 138 is free to rotate to allow movement in both the forward and reverse directions. However, it will be appreciated that if the robot 2 is traveling along a curved path, there will not only be a longitudinal component to the frictional force acting on the wheel from the floor surface but also a lateral component. As the wheel 138 is unable to rotate in a lateral direction, increased friction may build up between the floor surface and the wheel, which may cause the wheel to "rub" and be worn away over time. An extreme example of this would be when the robot 2 is turning about its vertical axis C. In this situation, there is no longitudinal component to the frictional force acting on the wheel, and so it does not rotate. However, the wheel continues to rub on the floor surface due to the lateral frictional force from the floor surface.

Figure 14:
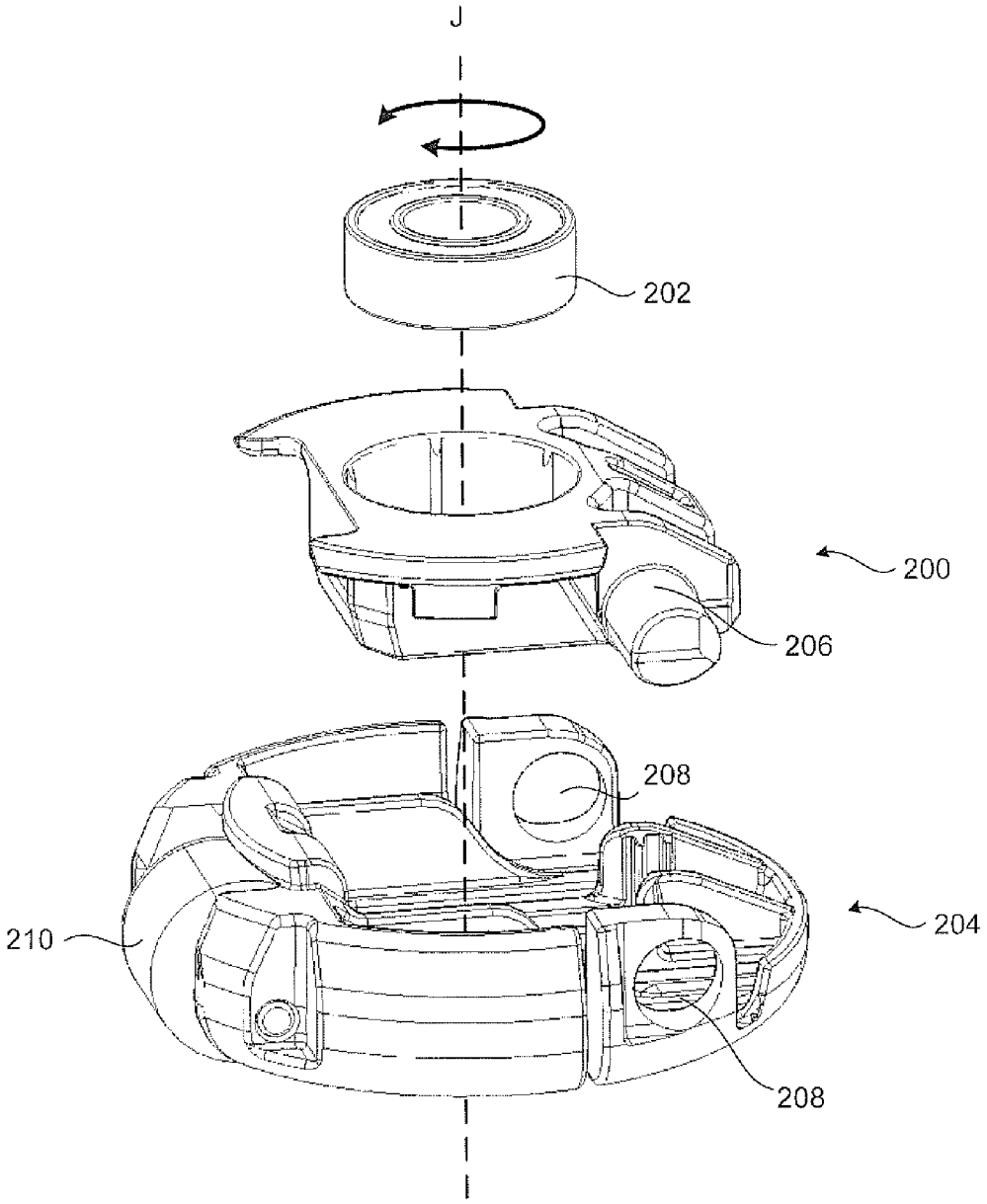
FIGS. 14, 15*a*, 15*b*, 16*a*, 16*b*, 17*a*, 17*b* and 17*c* show an alternative embodiment for the floor engaging support member.
Figure 15A:
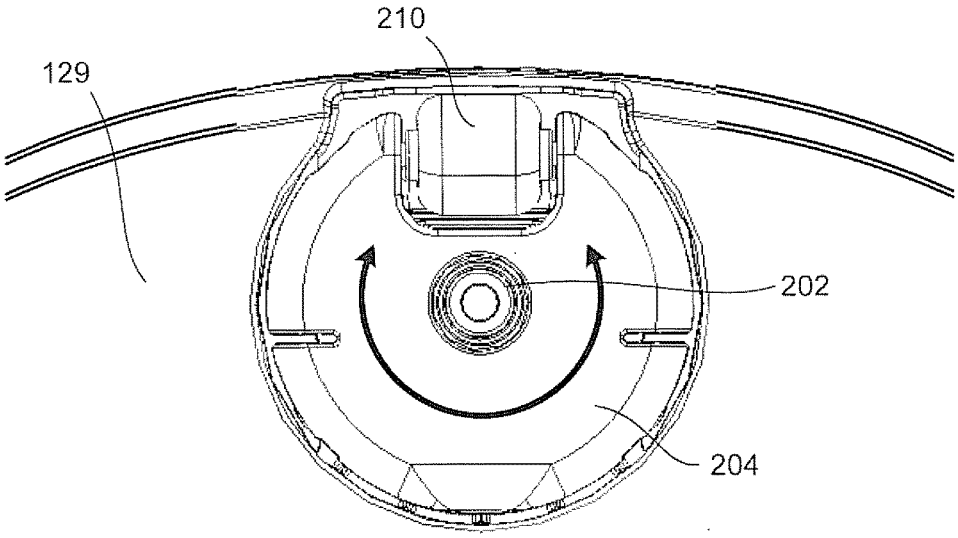
Figure 15B:
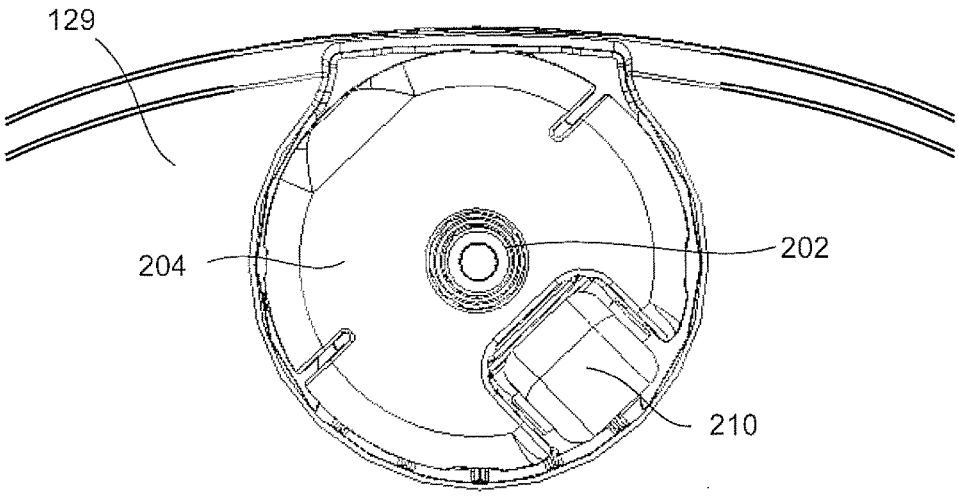

An alternative embodiment of a floor engaging support member is shown in FIGS. 14 to 17*c*. FIG. 14 shows an exploded view of the alternative floor engaging support member, which comprises a carrier 200, a bearing 202 and a swing arm 204. The carrier 200 is connected to the rear portion 129 of the chassis 4 by way of the bearing 212, such that the carrier 200 is freely rotatable about an axis J that is substantially parallel to the vertical axis C of the robot 2. The carrier 200 comprises a pivot pin 206 to which the swing arm 204 is pivotably mounted by way of the corresponding eyelets 208 into which the pivot pin 206 can engage. A wheel 210 is mounted to the swing arm 204. Therefore, as shown in FIGS. 15*a* and 15*b*, during use the carrier 200 and swing arm 204 can freely rotate around the centre of bearing 202, allowing the wheel 210 act as a caster wheel.

Figure 16A:
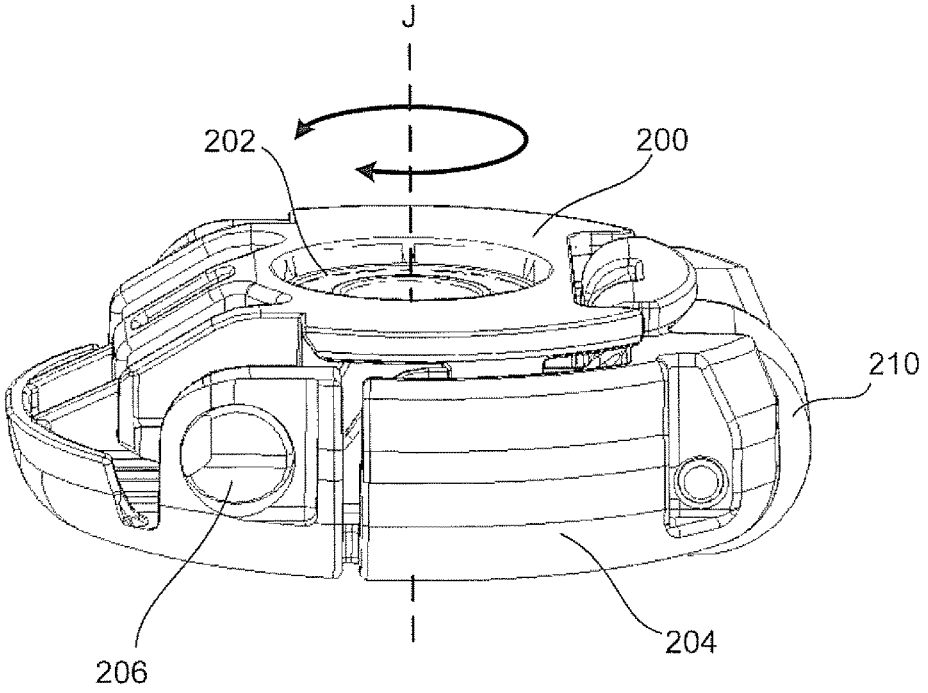
Figure 16B:
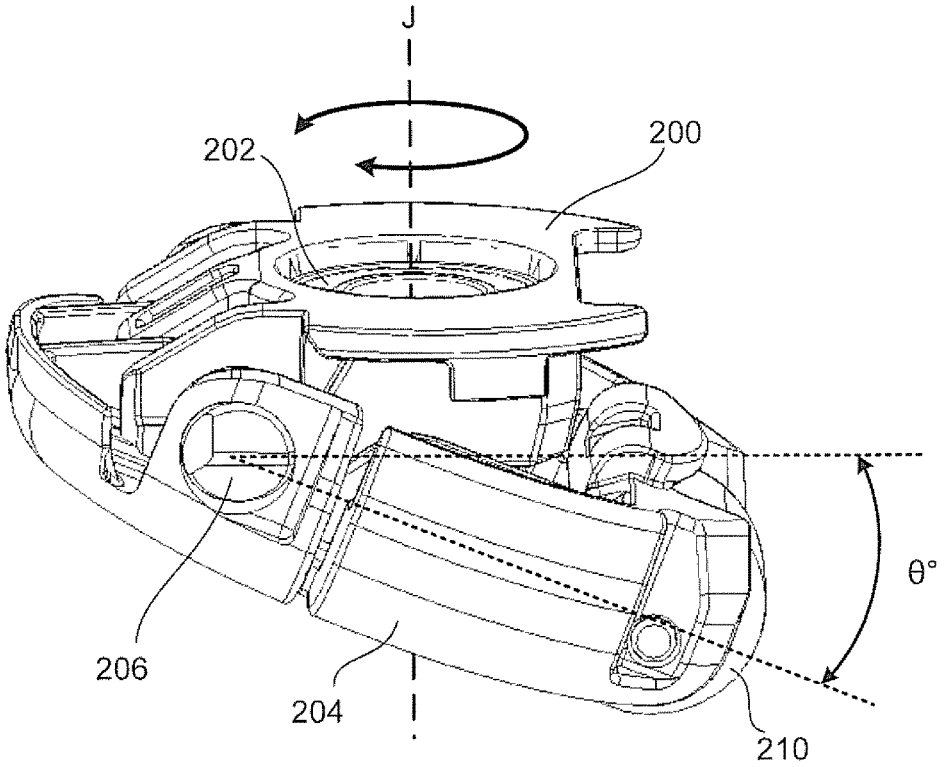

Similar to the earlier described embodiments, a torsion spring (not shown) acts to bias the swing arm 204 into a deployed position so as to bias the rear portion 129 of the robot 2 in a direction away from the floor surface. FIG. 16*a* shows the swing arm 204 in a retracted position, and FIG. 16*b* shows the swing arm in a deployed position. Whether retracted or deployed, the swing arm is still able to rotate freely about the axis J.

Figure 17A:
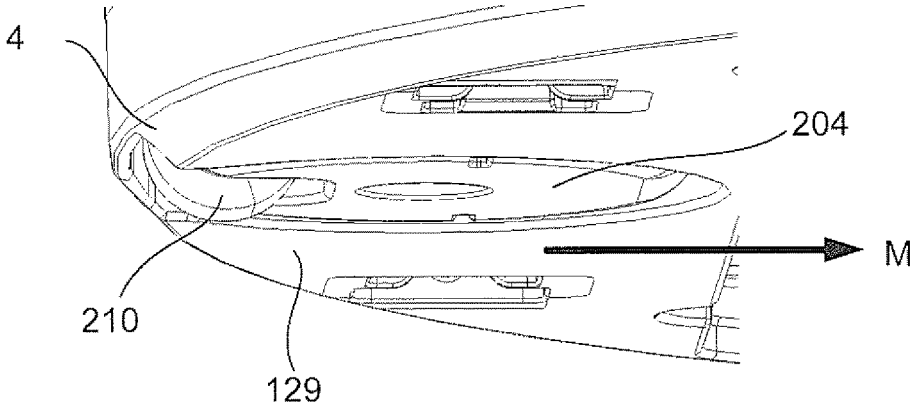
Figure 17B:
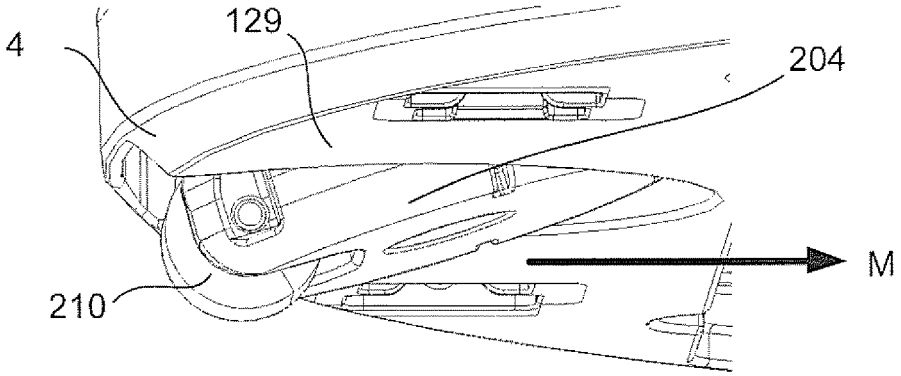
Figure 17C:
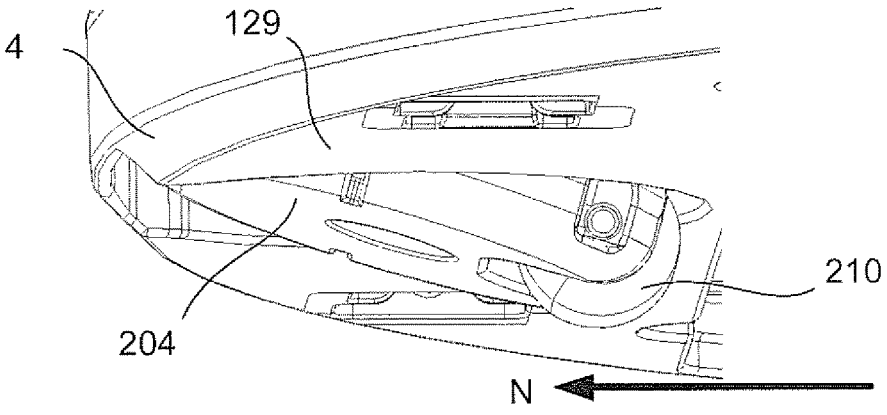

FIGS. 17*a, b* and *c* show the alternative floor engaging support member in place and fitted to the rear portion 129 of the chassis 4. In FIG. 17*a*, the swing arm 204 is in the retracted position. The direction of travel of the robot 2 is forward, as indicated by the arrow M, which means the wheel 210 is located at the point closest to the rear of the robot 2. In FIG. 17*b*, the swing arm 204 is in the deployed position, and as the direction of travel is the same as in FIG. 17*a*, the wheel is still at the rearmost point. FIG. 17*c* shows the swing arm in the deployed position again, but this time the direction of travel has reversed, N. In this instance the bearing 202 has enabled the carrier 200, swing arm 204 and wheel 210 to rotate 180° with respect to the chassis 4. Of course, it will be understood that when the robot 2 is turning about the central vertical axis C, the carrier 200, swing arm 204 and wheel 210 will rotate 90° such that the wheel 210 is able to rotate in the direction of travel of the rear of the rear of the machine.

This alternative embodiment of a floor engaging support member helps to prevent the wheel from wearing away during use whilst still allowing the swing arm to bias the rear portion of the robot away from the floor surface.

The above examples include supporting devices that support a rear portion of the mobile robot and urge it away from the floor surface with a substantially constant predetermined force. Both examples make use of floor engaging member that serves to upwardly bias the rear portion of the mobile robot. A comparable effect could be achieved by other means without including a spring-loaded support member, for example a moveable mass could be housed within the body of the robot and a detection system could be configured to move the mass forward within the robot body when the detection system has identified that the robot has become stuck during a climbing maneuver. This solution would ensure that all of the necessary components would be located internal to the mobile robot, which would avoid the need to locate floor engaging support members external to the body of the mobile robot which may attract dust and debris. However, it would be appreciated that such an 'internal' solution would be less cost-effective and would require a considerable volume of the internal space of the mobile robot.

The mobile robot 2 of the embodiment described above has a substantially circular profile in plan view and, in common with examples of known robotic vacuum cleaners, this shape is generally preferred since it allows the robot to move effectively into tight spaces and to maneuver its way out again without getting stuck. However, although such a circular profile lends itself to domestic applications such as floor cleaning tasks, other profile shapes are acceptable, such as rectilinear shapes in general. Furthermore, the invention is not intended to be limited to domestic mobile robots such as vacuum cleaners and is envisaged to be useful to a wider category of mobile robots that are required to navigate terrain and negotiate transitions in a floor surface. Some non-limiting examples may be a floor washing robot, a mobile sentry robot, a mobile payload-carrying robot.

The mobile robot described above has been described as being capable of driving itself autonomously over a floor surface. Of course, this is not intended to be limiting and the invention applies also to mobile robotic applications that are guided remotely or 'teleoperated' and also to semi-autonomous applications. Also, the floor surface need not be a floor of a domestic environment, but could be any ground surface on which the robot may travel.

The invention claimed is:

1. A mobile robotic vacuum cleaner comprising a body having a drive arrangement for driving the body on a surface, a bias for biasing a rear portion of the body in a direction away from the floor surface, the bias including a floor engaging support member for supporting a rear portion of the body on a floor surface, and a brushbar located between the drive arrangement and the bias, wherein the floor engaging support member rotates relative to the body about a substantially vertical axis, and wherein the floor engaging support member comprises a carrier rotatably mounted to the body and a swing arm pivotally mounted to the carrier, the carrier rotates relative to the body about a substantially vertical axis, and the swing arm pivots relative to the carrier about a substantially horizontal axis.

2. The mobile robotic vacuum cleaner of claim 1, wherein the floor engaging support member is urged against the floor surface with a predetermined force so as to bias the body away from the floor surface.

3. The mobile robotic vacuum cleaner of claim 1, wherein the floor engaging support member is movable between a first position in which it is stowed in a recess defined by the body and a second position in which it is deployed from the recess.

4. The mobile robotic vacuum cleaner of claim 1, wherein the swing arm pivots relative to the body of the mobile robotic vacuum cleaner.

5. The mobile robotic vacuum cleaner of claim 1, including a spring member that acts on the floor engaging support member.

6. The mobile robotic vacuum cleaner of claim 5, wherein the spring member is a torsion spring.

7. The mobile robotic vacuum cleaner of claim 5, wherein the spring member provides biasing force of approximately 5 Newtons.

8. The mobile robotic vacuum cleaner of claim 1, wherein the floor engaging support member is deployable to a distance of approximately 20 mm below the body.

9. The mobile robotic vacuum cleaner of claim 1, wherein the swing arm has a pivotal angular range of movement of approximately 30 degrees.

10. The mobile robotic vacuum cleaner of claim 1, wherein the floor engaging support member includes a wheel for engaging a floor surface.

11. The mobile robotic vacuum cleaner of claim 1, wherein the bias is located on a rear portion of the body and aligned on a longitudinal axis.

12. The mobile robotic vacuum cleaner of claim 1, wherein the bias is located on a rear portion of the body and aligned on a longitudinal axis, and wherein the bias is positioned adjacent a further floor engaging support member.

* * * * *